US007342158B2

(12) United States Patent
Olson

(10) Patent No.: US 7,342,158 B2
(45) Date of Patent: Mar. 11, 2008

(54) MUSICAL INSTRUMENT WITH MULTIPLE RESONANCE CHAMBERS

(76) Inventor: Dane Olson, 770 Broad Cove Rd., Hopkinton, NH (US) 03229

( * ) Notice: Subject to any disclaimer, the term of this patent is extended or adjusted under 35 U.S.C. 154(b) by 0 days.

(21) Appl. No.: 11/293,548

(22) Filed: Dec. 2, 2005

(65) Prior Publication Data

US 2007/0125221 A1 Jun. 7, 2007

(51) Int. Cl.
*G10D 1/00* (2006.01)

(52) U.S. Cl. ..... 84/173; 84/270; 84/307

(58) Field of Classification Search ..... 84/173, 84/267, 270, 268, 269, 297 R, 307; D14/16, D14/18, 20–21

See application file for complete search history.

(56) References Cited

U.S. PATENT DOCUMENTS

| | | | | | |
|---|---|---|---|---|---|
| 1,697,396 | A * | 1/1929 | Large | ..... | 84/263 |
| 2,098,701 | A * | 11/1937 | Cox | ..... | 84/267 |
| 2,820,389 | A * | 1/1958 | Marx | ..... | 84/285 |
| 4,069,732 | A * | 1/1978 | Moskowitz et al. | ..... | 84/727 |
| 4,903,567 | A * | 2/1990 | Justus | ..... | 84/294 |
| 5,780,758 | A * | 7/1998 | McGill | ..... | 84/296 |
| 6,563,033 | B1 * | 5/2003 | Porzilli | ..... | 84/294 |

* cited by examiner

*Primary Examiner*—Edwin A. Leon
(74) *Attorney, Agent, or Firm*—Bourque and Associates

(57) ABSTRACT

A device, system and method for a musical instrument are disclosed herein. The exemplary musical instrument may have a first resonance chamber having a first bridge coupled to a surface of the first resonance chamber and a second resonance chamber having a second bridge coupled to a surface of the second resonance chamber. At least one string may couple the first bridge to the second bridge.

20 Claims, 2 Drawing Sheets

MUSICAL INSTRUMENT WITH MULTIPLE RESONANCE CHAMBERS

TECHNICAL FIELD

The present invention relates to musical instruments and more particularly, relates to a musical instrument with multiple resonance chambers.

BACKGROUND INFORMATION

A musical instrument produces an arrangement of musical tones that are pleasing to the human ear. A tone is a sound that repeats at a certain specific frequency. A tone may be made up of a specific frequency or a small number of related frequencies. A string musical instrument uses vibrating strings to generate tones. The strings of the musical instrument are under tension and may vibrate at a specific frequency.

An acoustic guitar is a string musical instrument that transmits the vibration of the string to a resonance chamber. An acoustic guitar transmits the vibration of the string to a saddle. The saddle transmits the vibrations to the soundboard and the body of the guitar. The body of the acoustic guitar amplifies the sound and transmits the amplified sound out of the sound hole. However, the body of the acoustic guitar only amplifies one tone per string. Accordingly, a need exists for a device, method, and system that provides the user of the musical instrument the ability to amplify multiple tones from the tone generated by actuating one or more strings. In addition, the device, method, and system may also allow the user to manipulate the strings in three dimensions thus increasing the amount of performance techniques to the user. The device, method, and systems of the musical instrument may also provide longer vibrating strings that may provide more complex over tones.

SUMMARY

The present invention is a novel device, system, and method for a musical instrument. An exemplary embodiment, according to the present invention, may have a first resonance chamber having a first bridge coupled to a surface of the first resonance chamber and a second resonance chamber having a second bridge coupled to a surface of the second resonance chamber. At least one string is coupled to the first bridge and to the second bridge.

Alternate embodiments may include one or more of the following. The volume of the first resonance chamber may be a multiple of a volume of the second resonance chamber. The first resonance chamber may have a first sound hole and the second resonance chamber may have a second sound hole. The area of the second sound hole may be a multiple of the area of the first sound hole. In another embodiment, the musical instrument may have one or more sympathetic resonators coupled to the first resonance chamber or one or more sympathetic resonators coupled to the second resonance chamber. In another embodiment, the first bridge may be coupled to the first resonance chamber by a hinge adapted to change the angle of the strings as the bridge moves away from the first resonance chamber or the second bridge may be coupled to the second resonance chamber by a hinge adapted to change the angle of the strings as the bridge moves away from the second resonance chamber. In yet another embodiment, the musical instrument may have a frame that couples the first resonance chamber a predetermined distance from the second resonance chamber.

It is important to note that the present invention is not intended to be limited to a system or method which must satisfy one or more of any stated objects or features of the invention. It is also important to note that the present invention is not limited to the exemplary embodiments described herein. Modifications and substitutions by one of ordinary skill in the art are considered to be within the scope of the present invention, which is not to be limited except by the following claims.

BRIEF DESCRIPTION OF THE DRAWINGS

These and other features and advantages of the present invention will be better understood by reading the following detailed description, taken together with the drawings wherein.

DETAILED DESCRIPTION

The musical device has two or more resonance chambers. The user activates the musical device by causing one or more strings to vibrate. The vibration of the string is transferred to a first resonance chamber on one end of the string and to a second resonance chamber on the other end of the string. A bridge and/or saddle may be used to transfer the vibration to the resonance chambers. Inside the resonance chambers the frequency is amplified and passed out of the resonance chamber via respective sound holes of the resonance chambers. The vibration of additional strings may also generate harmonic tones to provide a tone envelope. In addition, sympathetic resonators may also be coupled to either or both resonance chambers.

Figure 1:
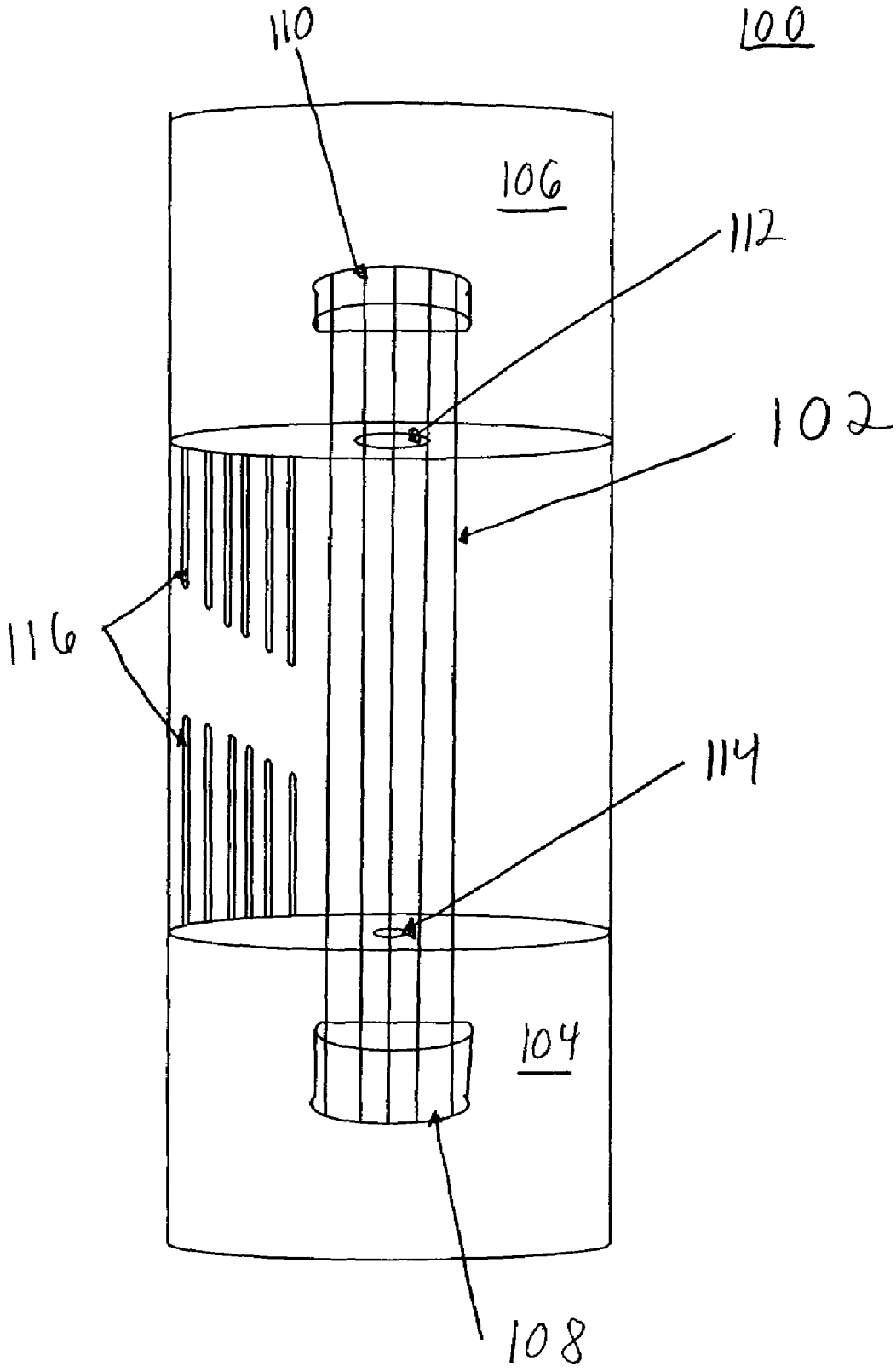
FIG. 1 is a front isometric view of the musical instrument according to a first exemplary embodiment.

Referring to FIG. 1, the musical device 100 of a first exemplary embodiment has one or more strings 102. The strings 102 are coupled to a first resonance chamber 104 and a second resonance chamber 106. A first bridge 108 is used to couple the one end of the string 102 to the first resonance chamber 104. A second bridge 110 is used to couple the other end of the string 102 to the second resonance chamber 106. The bridges 108, 110 allow the vibrations of the string to be transferred through the surface of the resonance chambers 104, 106 to the interior. The bridges 108, 110 may use a variety of devices to couple to the string 102. For example, the string 102 may be coupled via a tuning screw. The tuning screw (not shown) may allow the user to adjust the tension of the string 102 by turning the screw in order to tune the frequencies generated by the vibrating string 102. The strings 102 may be a variety of different sizes and materials. A variety of different diameter strings 102 may be used as well to provide different notes and generate harmonic frequencies when other strings 102 are excited.

The vibrations are amplified in the interior of the resonance chamber 104, 106 based on the volume and shape of the resonance chamber 104, 106. The sound is transmitted from the interior of the resonance chambers 104, 106 to the outside via sound holes 112, 114. The tones and frequencies amplified by the resonance chamber 104, 106 may be adjusted by changing the shape and area of the sound holes 112, 114. Altering the size and shape of the sound hole 112, 114 for each resonance chamber 104, 106 may allow the air inside to vibrate at a single frequency, the Helmholtz resonance frequency for the resonance chamber 104, 106. The resonance chambers 104, 106 may allow the user to change the size of the sound holes 112, 114 to adjust the frequency provided by the musical device 100. For example, the device may include a variety of lids with various shapes and/or sizes of sound holes. The user may select the desired frequency generated by selecting between the various different lids.

The resonance chambers 104, 106 may also be replaced with an electronic amplification system. According to an electronic amplification embodiment, the vibrations of the strings 102 are received and amplified by an electronic amplifier (not shown). The electronic amplifier may be tuned to produce the desired amplified tune based on the vibration of the string. The electronic amplifier may use similar technology to that found in electronic guitars.

The musical device 100 may also have sympathetic resonators 116. For example, pipes may be coupled to a top or side of each resonance chamber 104, 106. By adjusting the diameters and length, a variety of sympathetic frequencies may be generated from the frequency generated by the strings 102. The number of sympathetic resonators 116 provided and the frequencies generated by the sympathetic resonators 116 may be selected based on the desired envelope of the notes generated by the musical device 100. The envelop of the note provides a buildup and trail to the note creating a smoother transition.

The strings 102 may be activated using a variety of devices and techniques. For example, a user may use their fingers or a pick to pluck the strings 102. The user may also use a bow or other instrument to excite the strings 102. The user may dampen or excite the strings 102 by tightening them vertically, pulling backwards or forwards, and/or moving the strings from side to side. The user may also use pads or plates coupled to the user's body to dampen or excite the string 102 vibrations.

Figure 2:
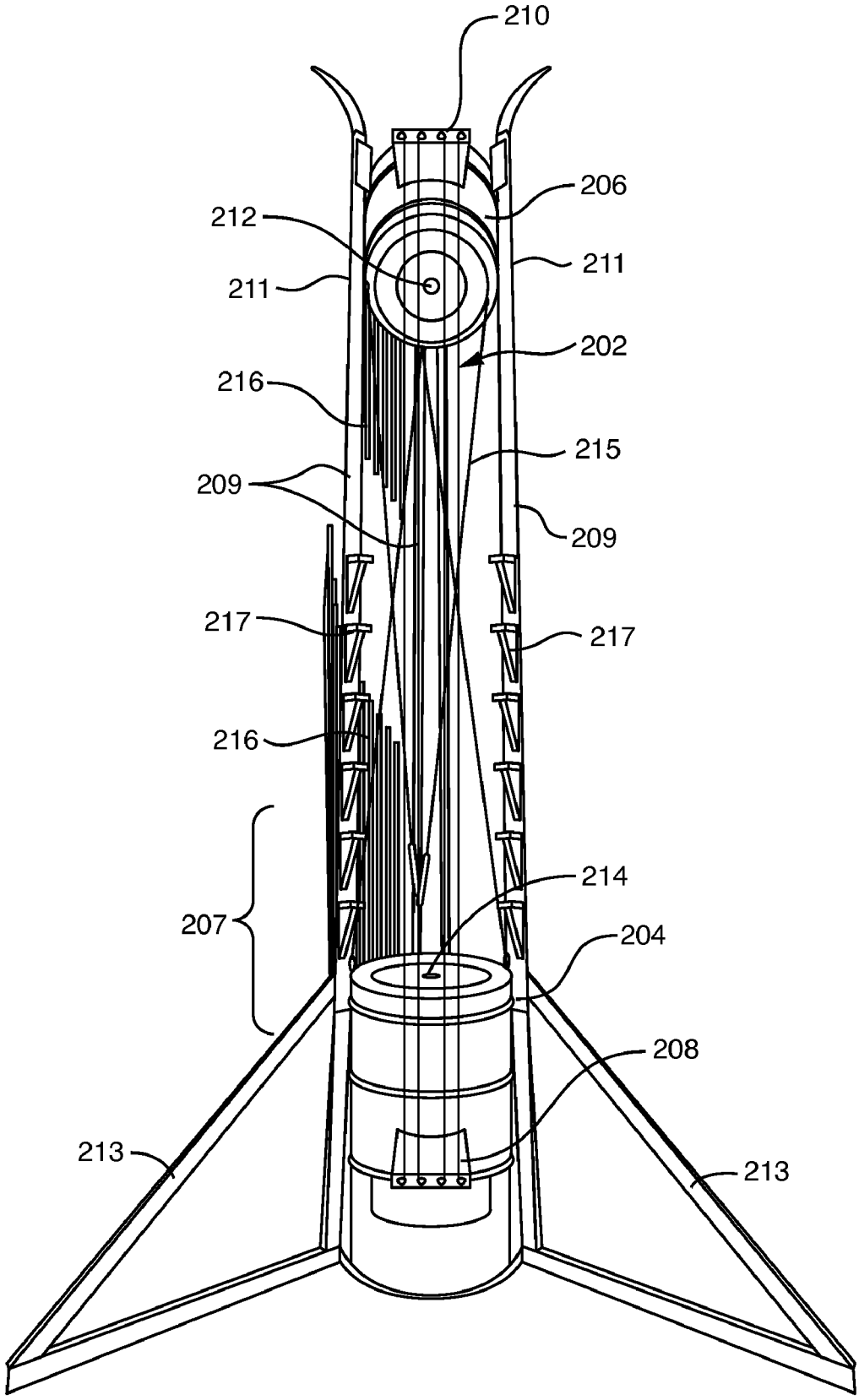
FIG. 2 is a perspective view of the musical instrument according to a second exemplary embodiment.

Referring to FIG. 2, the musical device 200 of a second exemplary embodiment positions a bottom resonance chamber 204 over top of a top resonance chamber 206. The user may manipulate one or more strings 202 by positioning the user's body between the resonance chambers 204, 206. A frame 207 having three upright members 209 couples to the side of the bottom resonance chamber 204. The top resonance chamber 206 is coupled to the top portion of the three upright members 211 and may be raised over the bottom chamber 204 by about three meters. The distance may be varied based on the desired lengths of string. Three legs 213 extend from the frame 207 and provide supports for the musical device 200. Additional cables 215 may be provided to provide vertical and horizontal support to the frame 207.

The frame 207 may be designed to allow the musical device 200 to be disassembled for transport or storage. For example, a hinge joint 217 may be used to couple the upright members 211 to the top resonance chamber 206 to allow the user the ability to raise and lower the top resonance chamber 206 by moving the upright members 211 from a horizontal position to a vertical position. The frame 207 may then be locked into place by coupling the bottom of the upright members 211 to the sides of the bottom resonance chamber 204.

The frame 207 may also provide steps 217 on two or more of the upright members 211 to allow the user to move up and down while manipulating the strings 402. The full length of the strings 402 may be reached by climbing the steps 217 on the upright members 211 of the frame 207. This allows the user to maneuver up and down the musical device 200 and manipulate the strings 202 at different lengths during a performance. Greater ease of motion may be achieved through a counterweighted harness system coupled to the user.

The top resonance chamber 206 and bottom resonance chamber 204 may have six strings 202 coupled via a top tailpiece 210 and a bottom tailpiece 208 respectively. The volume of the top resonance chamber 206 may be half the volume of the bottom resonance chamber 204 providing one octave difference between the frequencies amplified by the respective chambers 204, 206. The top tailpiece 210 may have a top bridge coupling the top portion of the strings 202 to the top resonance chamber 206 and the bottom tailpiece 208 may have a bottom bridge coupling the bottom portion of the strings 202 to the bottom resonance chamber 204. The tailpieces 208, 210 may be fastened to the resonance chamber 204, 206 with a hinge. This allows the tailpiece's 208, 210 angles, relative to the resonance chambers 204, 206, to change as needed. If a taller bridge is used the angle may widen and the strings 202 may move further from the resonance chamber 204, 206. As the location of the bridge may change along the resonance chamber's height for tonal effect, the tailpiece 208, 210 may be adjusted to meet the required angle of the strings 202.

The bottom tailpiece 208 may have one machine head for each string built into the upper edge. The top tailpiece 210 may have one clamping bolt with a wing nut for each string 202; this serves to hold the string ends firmly in place behind the top bridge. The top tailpiece 210 and bottom tailpiece 208 structure may eliminate the need for a traditional headstock or scroll.

The musical device 200 of the second exemplary embodiment may have a total of twenty-four sympathetic resonators 216. Twelve sympathetic resonators 216 may be coupled to the bottom resonance chamber 204 and twelve sympathetic resonators 216 may be coupled to the top resonance chamber 206. The sympathetic resonators 216 may be made of, for example, steel pipes. The bottom resonance chamber 204 may have a low octave of the 12-tone scale made up of 12 different length pipes. The top resonance chamber 206 may have the same feature, one octave higher with 12 different length pipes.

The musical device 200 according to the second exemplary embodiment allows total access to the strings 202. The strings 202 may be stopped and manipulated with any one or many of the player's body parts or additional tools. The strings 202 can be manipulated in all three dimensions; twisted to tighten vertically, pulled backwards and forwards, and moved from side to side. This provides an increase in the amount of possibilities for performance techniques and sound results.

Modifications and substitutions by one of ordinary skill in the art are considered to be within the scope of the present invention, which is not to be limited except by the following claims.

The invention claimed is:

1. A musical instrument comprising:

a first resonance chamber having a first bridge coupled to a surface of the first resonance chamber;

a second resonance chamber having a second bridge coupled to a surface of the second resonance chamber wherein a volume of space producing the second resonance chamber is separate and isolated from a volume of space producing the first resonance chamber; and at least one string coupling the first bridge to the second bridge.

2. The musical instrument of claim 1, wherein a volume of the first resonance chamber is a multiple of a volume of the second resonance chamber.

3. The musical instrument of claim 1, wherein the first resonance chamber has a first sound hole and the second resonance chamber has a second sound hole.

4. The musical instrument of claim 1, wherein the first resonance chamber and the second resonance chanter are electronic amplifiers.

5. The musical instrument of claim 1, further comprising:

one or more sympathetic resonators coupled to the first resonance chamber and one or more sympathetic resonators coupled to the second resonance chamber.

6. The musical instrument of claim 1, wherein the first bridge is coupled to the first resonance chamber by a hinge adapted to change the angle of the strings as the bridge moves away from the first resonance chamber and the second bridge is coupled to the second resonance chamber by a hinge adapted to change the angle of the strings as the bridge moves away from the second resonance chamber.

7. The musical instrument of claim 1, further comprising a frame that couples the first resonance chamber a predetermined distance from the second resonance chamber.

8. The musical instrument of claim 1, further comprising an activator for causing the strings to vibrate.

9. A method for producing music comprising:

vibrating at least one string;

causing a first end of the string to produce a first tone in a first resonance chamber; and causing a second end of the string to produce a second tone in a second resonance chamber wherein movement of air producing the second tone in the second resonance chamber is isolated from movement of air producing the first tone in the first resonance chamber.

10. The method for producing music of claim 9, wherein a volume of the first resonance chamber is a multiple of a volume of the second resonance chamber.

11. The method for producing music of claim 9, further comprising adjusting wherein the first resonance chamber has a first sound hole and the second resonance chamber has a second sound hole.

12. The method for producing music of claim 9, further comprising:

causing one or more sympathetic resonators coupled to the first resonance chamber to produce harmonic tones.

13. The method for producing music of claim 9, further comprising:

causing one or more sympathetic resonators coupled to the second resonance chamber to produce harmonic tones.

14. The method for producing music of claim 9, further comprising:

tuning the resonance chambers by removing a sound hole plate of the resonance chamber and vibrating the string.

15. A musical device comprising:

a bottom cylindrical resonance chamber having a round bottom sound plate with a bottom sound hole on the top of the bottom resonance chamber and a bottom bridge coupled to a side surface of the bottom resonance chamber;

a top cylindrical resonance chamber having a round top sound plate with a top sound hole on the bottom of the top resonance chamber and a bottom bridge coupled to a side surface of the top resonance chamber;

a frame coupled to the bottom resonance chamber and supporting the top resonance chamber vertically above the bottom resonance chamber wherein the frame has steps adapted to support the user between the top resonance chamber and the bottom resonance chamber; and at least one string coupled at one end to the bottom bridge and the other end to the top bridge.

16. The musical device of claim 15, wherein the strings have lengths of greater than about three meters.

17. The musical device of claim 15, wherein the frame may be collapsed and the top resonance chamber and bottom resonance chamber decoupled for storage.

18. The musical device of claim 15, further comprising:

one or more sympathetic resonators coupled to the top resonance chamber and one or more sympathetic resonators coupled to the bottom resonance chamber.

19. The musical device of claim 15, wherein the bottom bridge is coupled to the bottom resonance chamber by a hinge adapted to change the angle of the strings as the bottom bridge moves away from the bottom resonance chamber and the top bridge is coupled to the top resonance chamber by a hinge adapted to change the angle of the strings as the top bridge moves away from the top resonance chamber.

20. The musical device of claim 15, wherein the strings are coupled to the bottom bridge by a threaded stud and a nut.

* * * * *